US007677410B2

(12) United States Patent
Lee

(10) Patent No.: US 7,677,410 B2
(45) Date of Patent: Mar. 16, 2010

(54) APPARATUS FOR DISCHARGING TISSUE

(75) Inventor: Jin Yong Lee, Seoul (KR)

(73) Assignee: Elix Co., Ltd. (KR)

( * ) Notice: Subject to any disclaimer, the term of this patent is extended or adjusted under 35 U.S.C. 154(b) by 0 days.

(21) Appl. No.: 11/662,991

(22) PCT Filed: Sep. 13, 2005

(86) PCT No.: PCT/KR2005/003016

§ 371 (c)(1),
(2), (4) Date: Mar. 15, 2007

(87) PCT Pub. No.: WO2006/031047

PCT Pub. Date: Mar. 23, 2006

(65) Prior Publication Data

US 2008/0135570 A1 Jun. 12, 2008

(30) Foreign Application Priority Data

Sep. 17, 2004 (KR) ..... 10-2004-0074672

(51) Int. Cl.
*B65H 3/26* (2006.01)

(52) U.S. Cl. ..... 221/258; 221/176; 221/210; 221/253; 221/268

(58) Field of Classification Search ..... 221/210, 221/258; 211/85.3; 271/42, 107
See application file for complete search history.

(56) References Cited

U.S. PATENT DOCUMENTS 2,950,589 A * 8/1960 Litchard ..... 53/573
3,416,705 A * 12/1968 Hohmann ..... 221/2
3,642,170 A * 2/1972 Shelley ..... 221/226
3,854,714 A * 12/1974 Hatanaka et al. ..... 271/12
3,937,453 A * 2/1976 Hickey et al. ..... 271/4.09
3,960,291 A * 6/1976 Navi ..... 221/36
4,216,877 A * 8/1980 Dutro ..... 221/213
4,469,246 A * 9/1984 Albright et al. ..... 221/225
4,494,743 A * 1/1985 Kushmaul et al. ..... 271/11
4,643,413 A * 2/1987 Ward et al. ..... 271/95
4,947,026 A 8/1990 Groom et al.

(Continued)

FOREIGN PATENT DOCUMENTS

WO WO-00/53073 A1 9/2000

OTHER PUBLICATIONS

International Search Report and Written Opinion of the International Searching Authority for PCT/KR2005/003016, dated Dec. 20, 2005; ISR/KR.

*Primary Examiner*—Gene Crawford
*Assistant Examiner*—Kelvin L Randall, Jr.
(74) *Attorney, Agent, or Firm*—Harness, Dickey & Pierce, P.L.C.

(57) ABSTRACT

An apparatus for discharging tissue that is folded several times and stacked is provided. The apparatus includes a cartridge that holds stacked tissue and has a through hole at one end, and a holding member that is disposed adjacent to the through hole of the cartridge and pivots on an axis to grasp and remove tissues one at a time from the top of the stack through an arm. The inventive apparatus allows a user to easily replace tissue and check the amount of tissue used and the amount left to use through visual means. The apparatus virtually eliminates the problem of tissue dispensing failure, and has increased precision and reliability and reduced dispensing time over conventional apparatuses.

13 Claims, 12 Drawing Sheets

U.S. PATENT DOCUMENTS 5,041,879 A * 8/1991 Akao et al. ..... 271/107
5,044,556 A 9/1991 Suzuki et al.
5,082,268 A * 1/1992 Santoro ..... 271/14
5,127,645 A * 7/1992 Torisawa ..... 271/11
5,152,513 A * 10/1992 Ogasawara et al. ..... 271/3.07
5,195,732 A * 3/1993 Focke ..... 271/11
5,215,301 A * 6/1993 Oshino et al. ..... 271/212
5,375,616 A * 12/1994 Chen ..... 134/105
6,179,280 B1 * 1/2001 Coppolo et al. ..... 271/2
6,382,460 B1 5/2002 Gonzalez et al.
2003/0230047 A1 * 12/2003 Smith et al. ..... 53/155
2005/0045531 A1 * 3/2005 Bretschneider et al. ..... 209/584
2005/0145491 A1 * 7/2005 Amano et al. ..... 204/403.02

* cited by examiner

[Fig. 1]
Prior Art
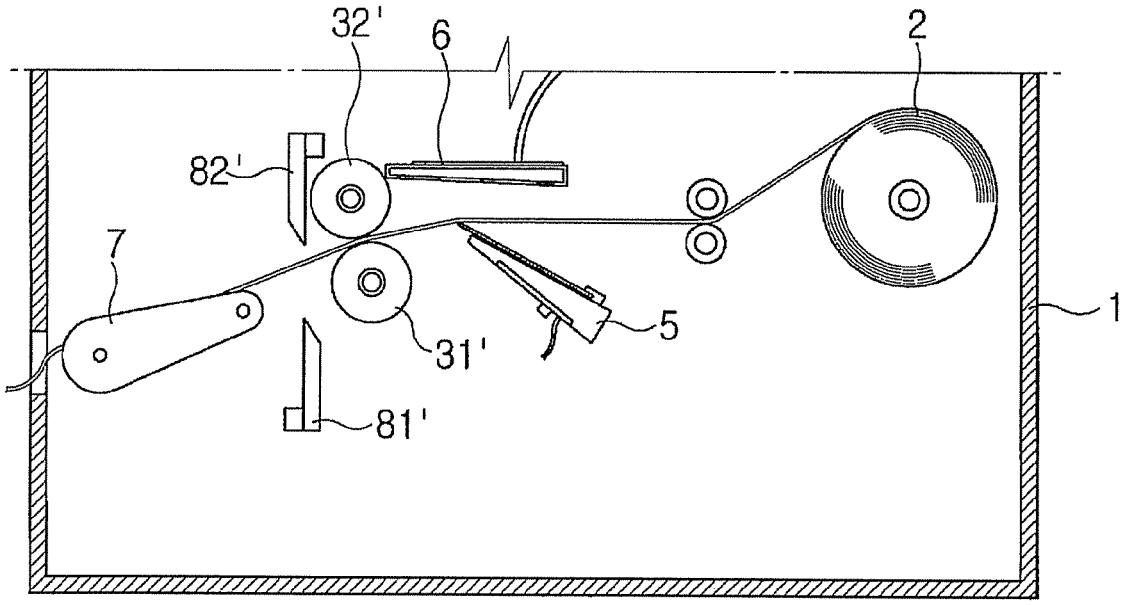

[Fig. 2]
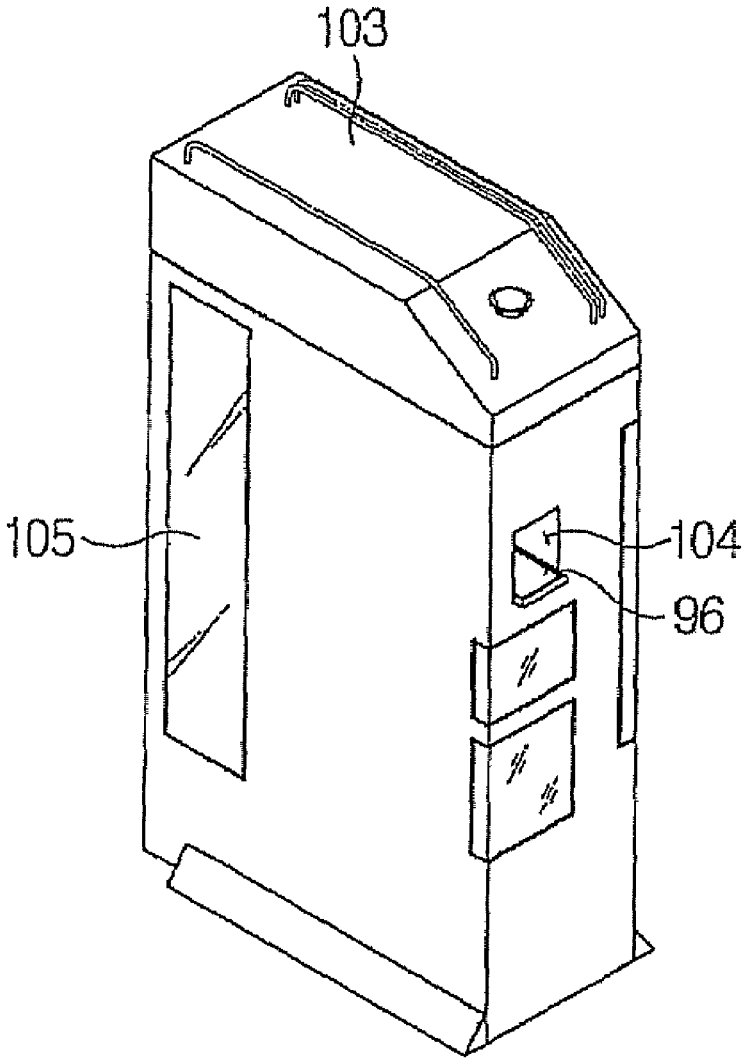

[Fig. 3]
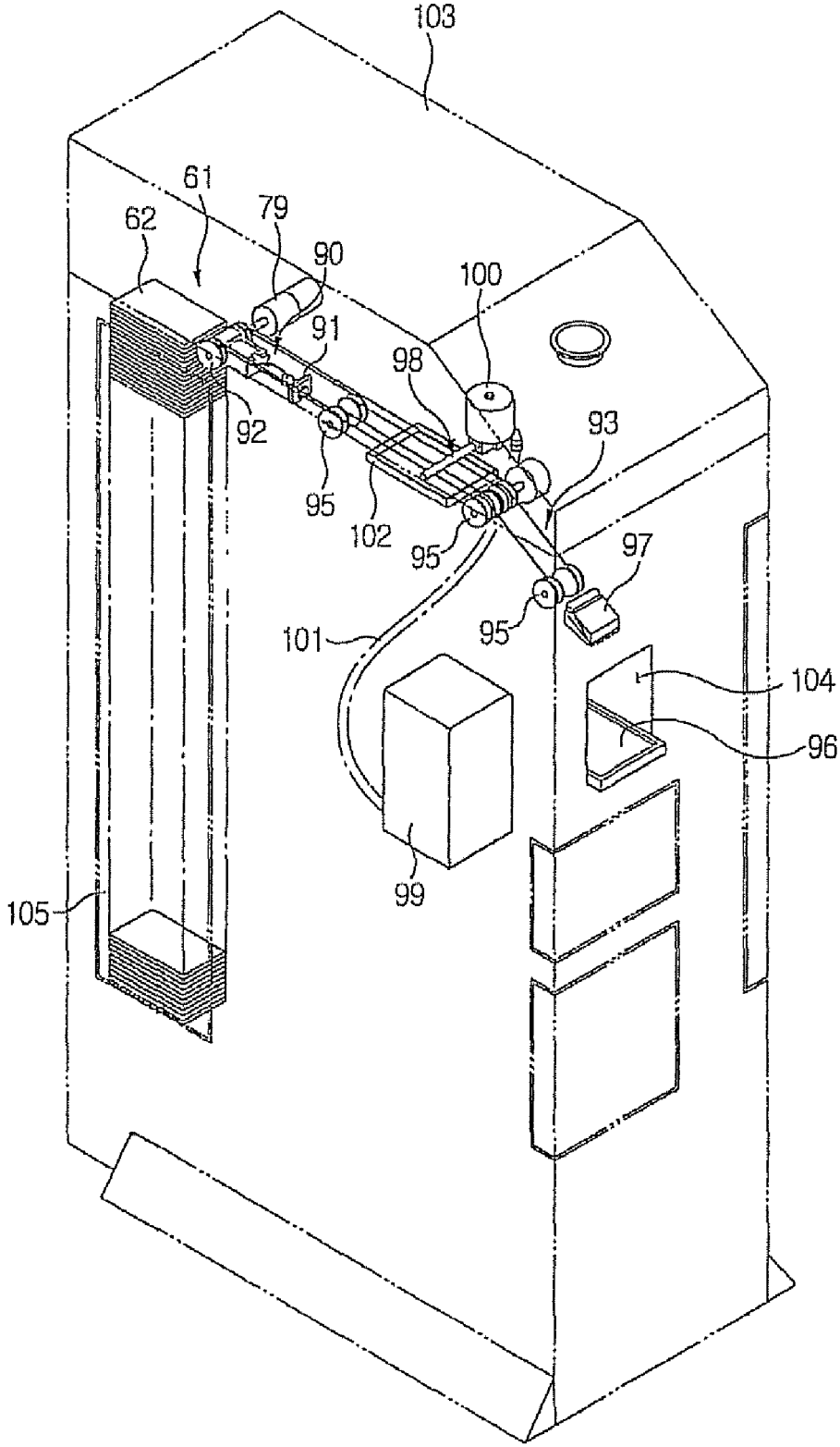

[Fig. 4]
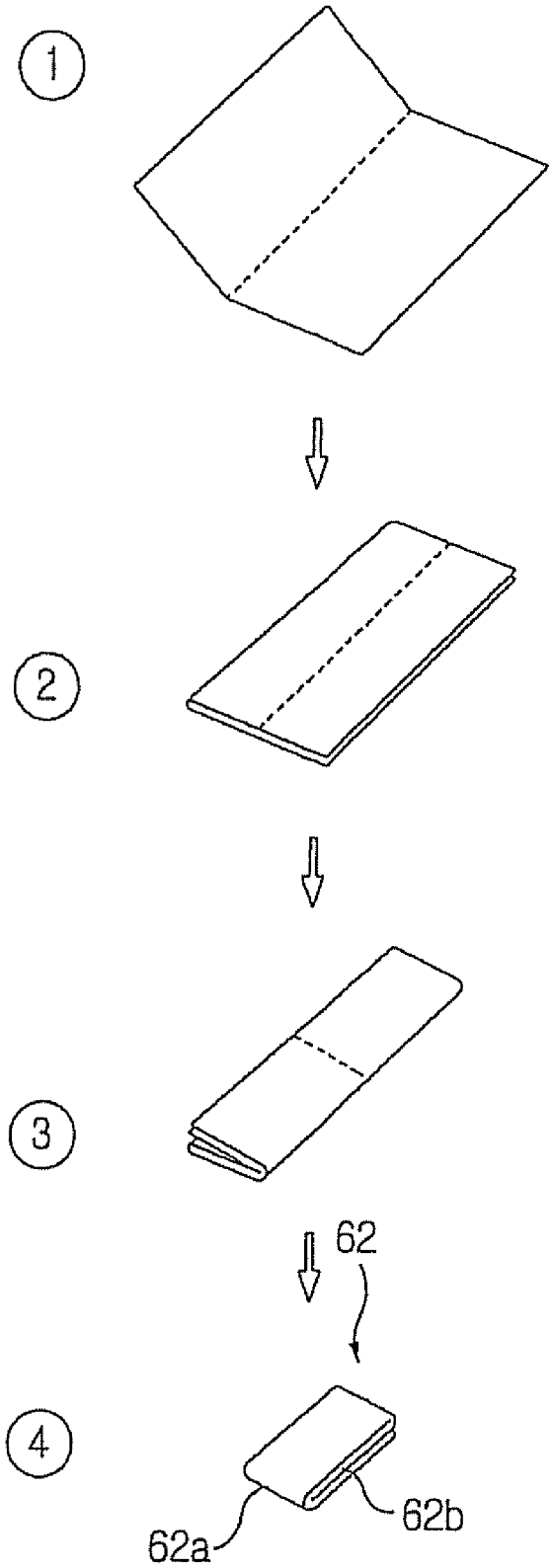

[Fig. 5]
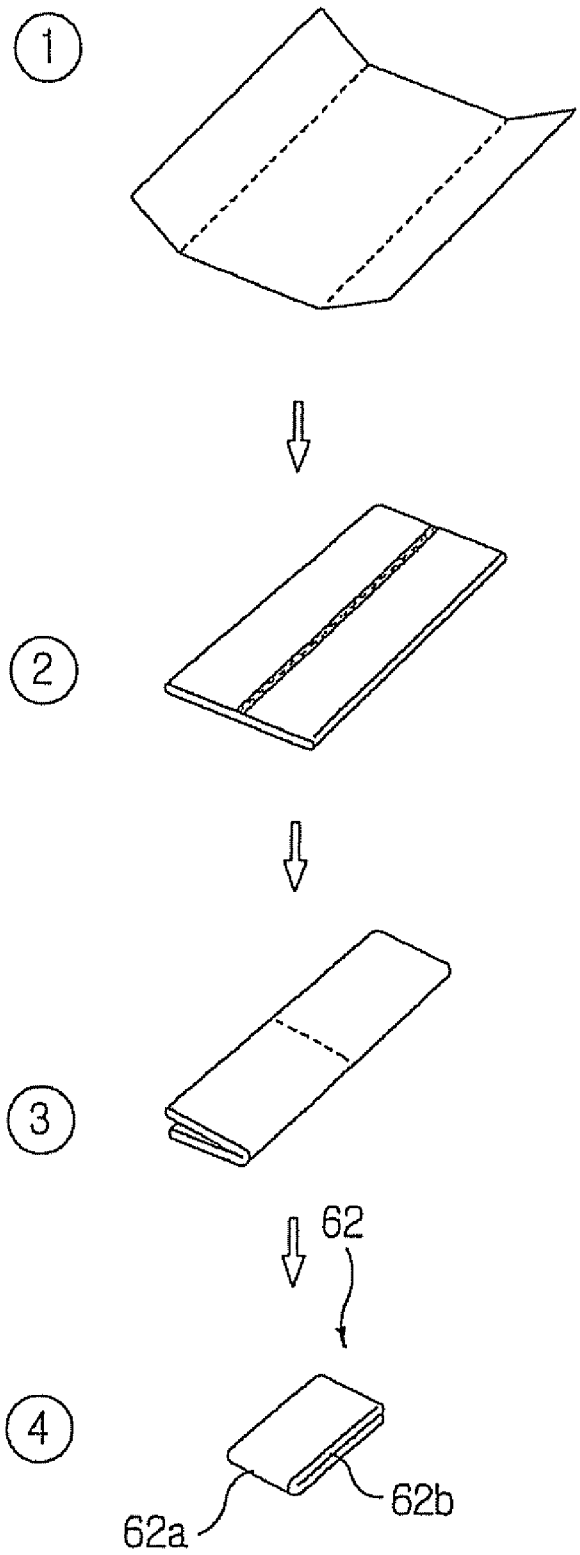

[Fig. 6]
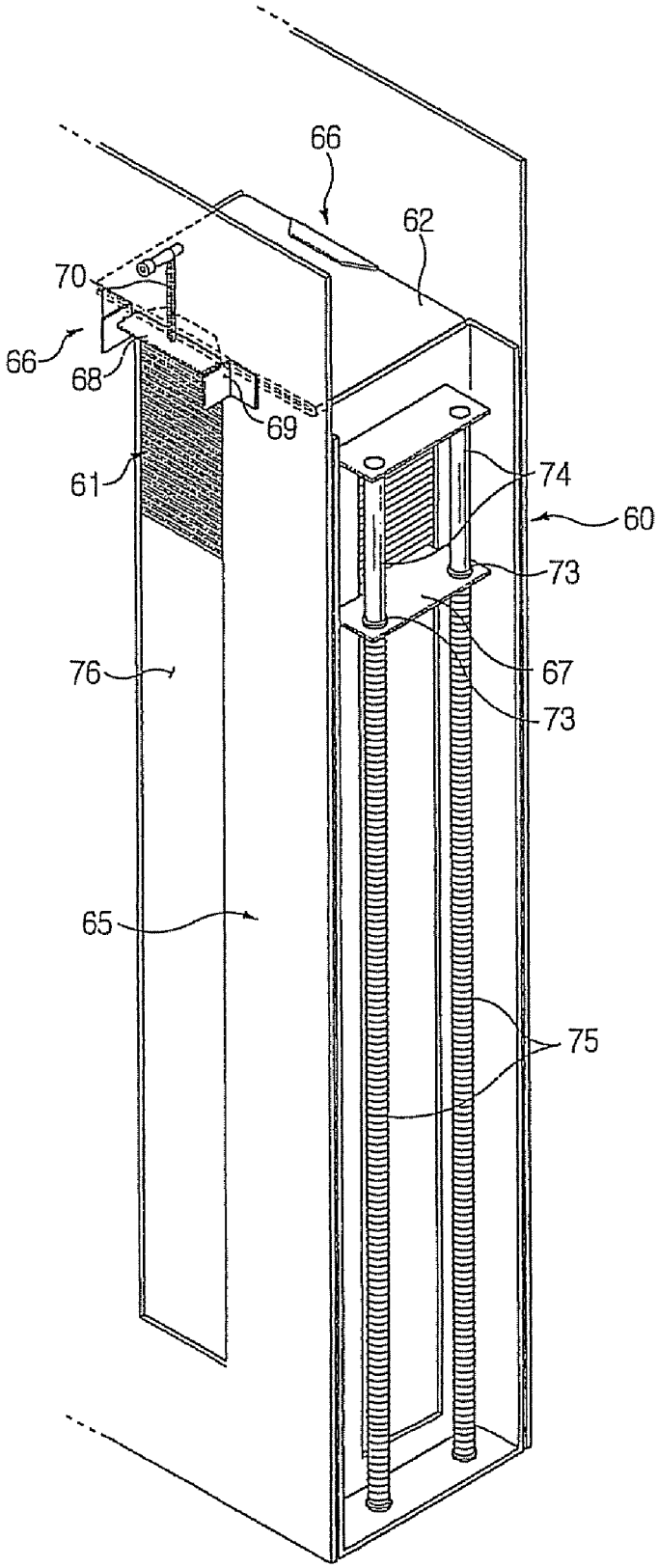

[Fig. 7]
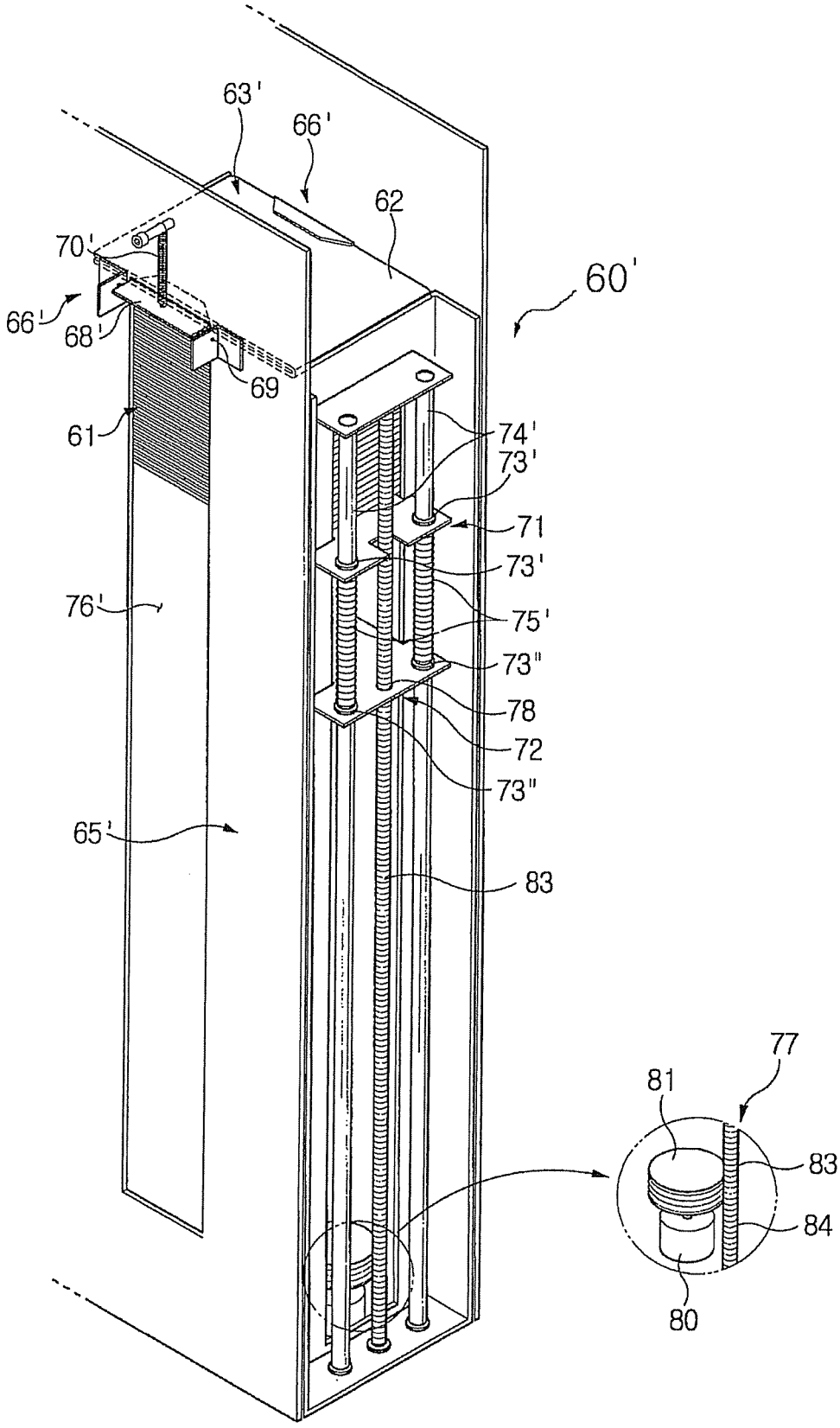

[Fig. 8]
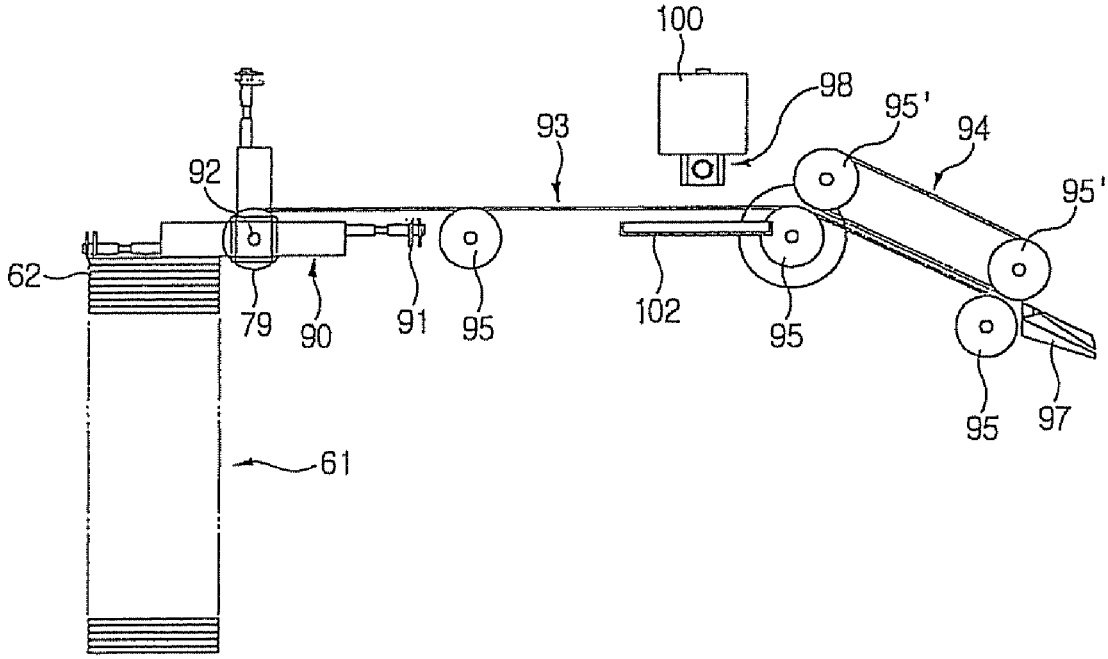

[Fig. 9]
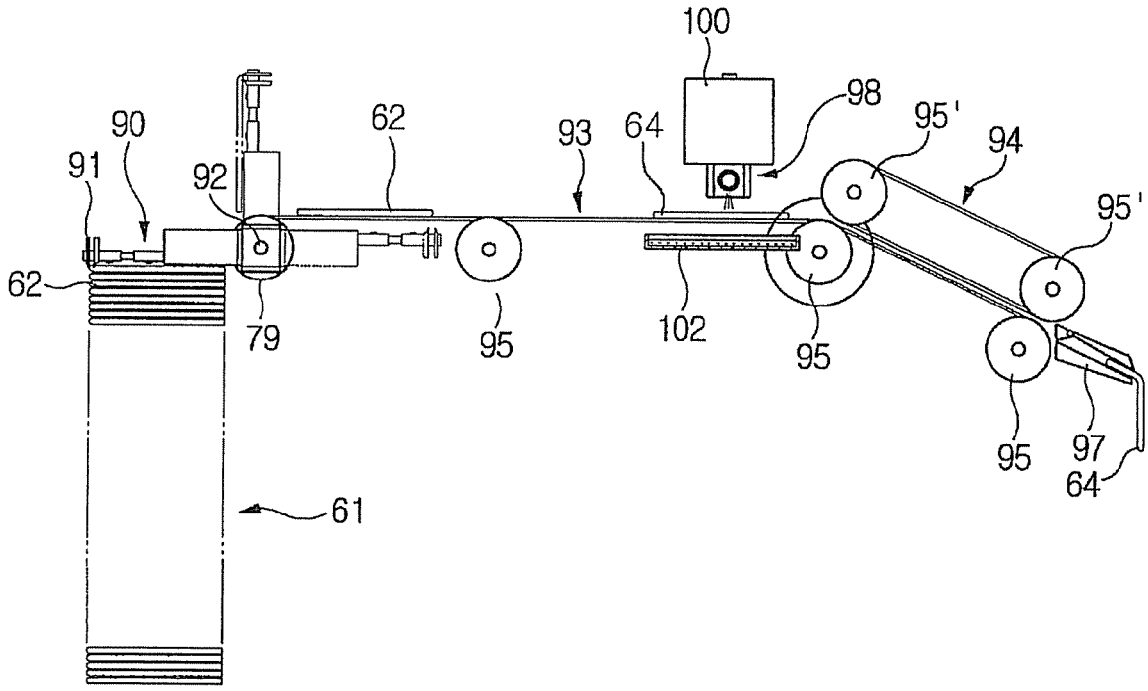

[Fig. 10]
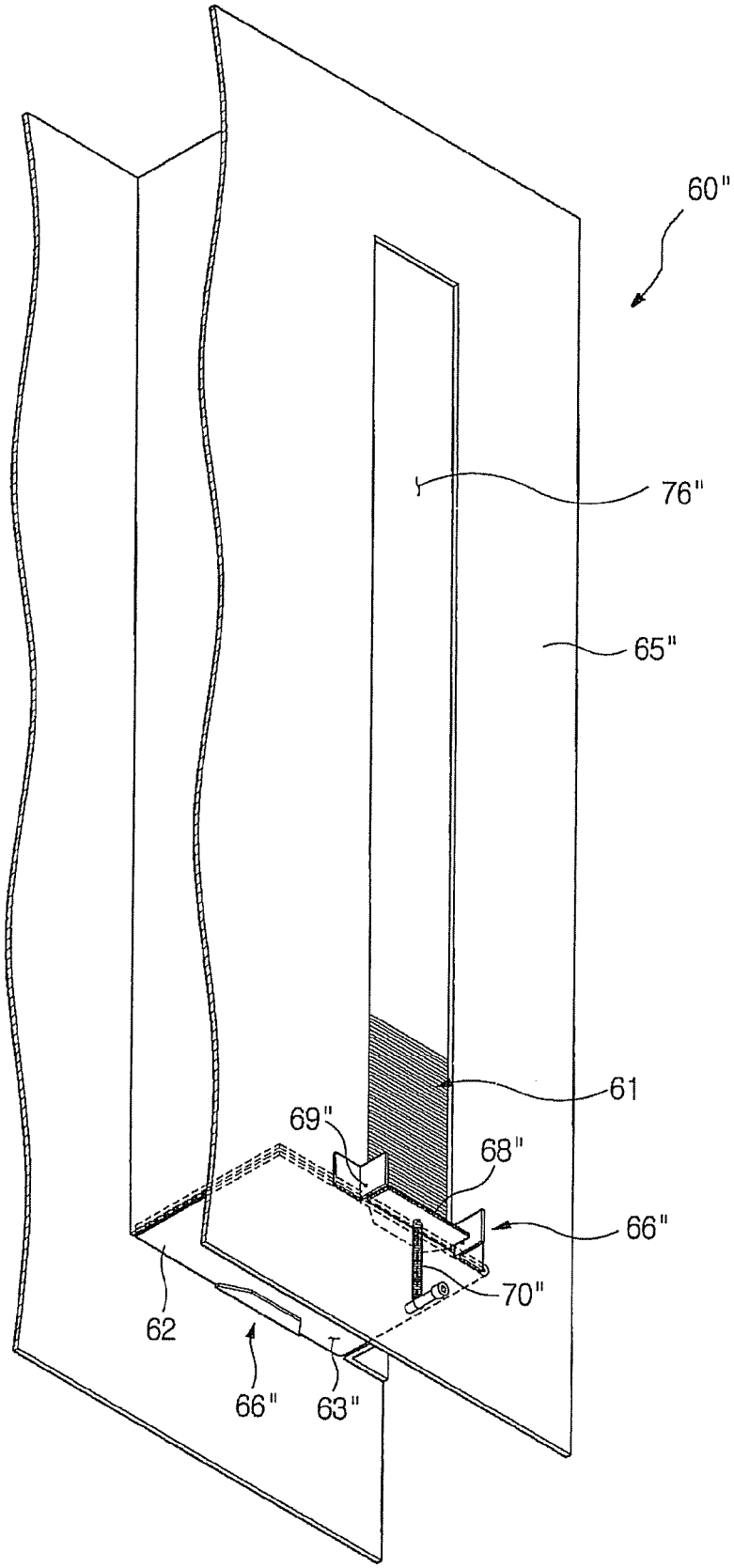

[Fig. 11]
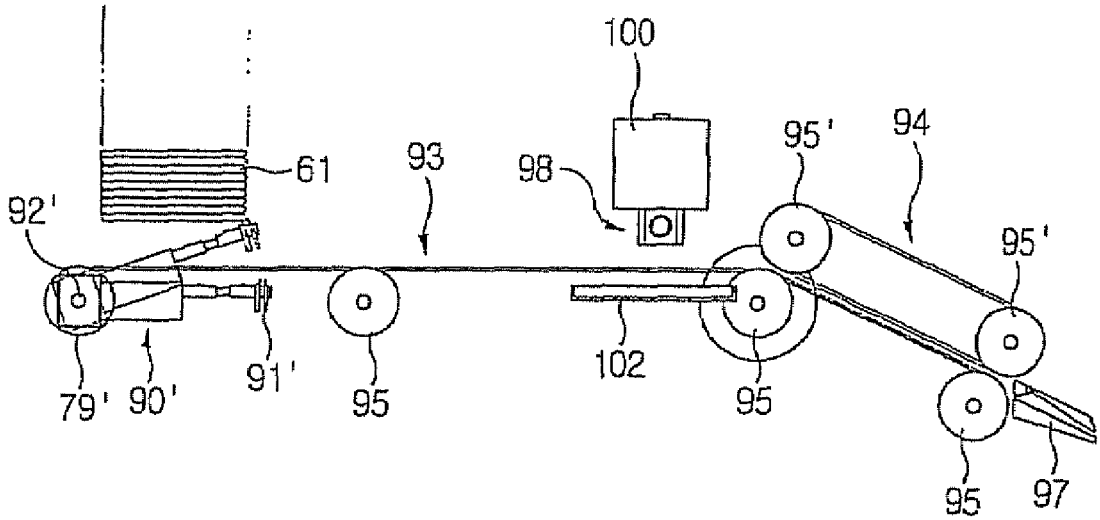

[Fig. 12]
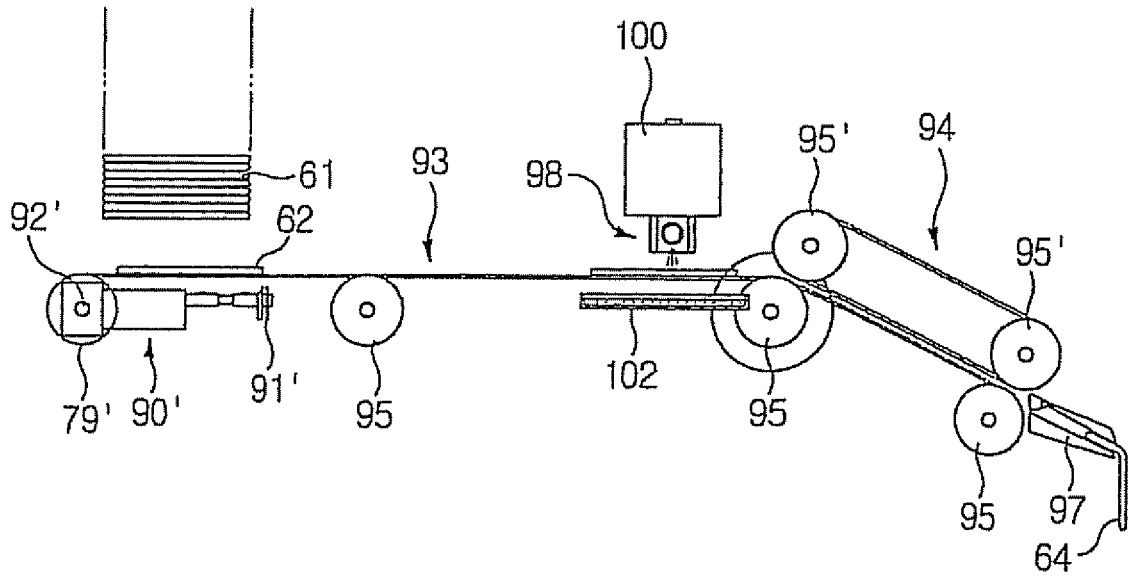

APPARATUS FOR DISCHARGING TISSUE

TECHNICAL FIELD

The present invention relates to an apparatus for discharging tissue, and more particularly, to an apparatus for discharging tissue one at a time, the tissue being of a type that is folded several times and stacked on top of one another.

BACKGROUND ART

Many restaurants offer customers wet towels to wipe their hands before a meal.

These wet towels are usually reusable towels that are collected after use, laundered, and offered to subsequent customers. However, washing wet towels consumes a large quantity of water. Also, due to the possibility of residual chemicals and germs remaining in wet towels after laundering, from sanitary and environmental standpoints, the use of wet towels is problematic.

To overcome the problems posed by the use of wet towels, many restaurants are now using disposable wet tissues individually packaged in plastic.

However, haphazard disposal of such plastic packaging augments environmental pollution.

Recently, traditional and fast-food restaurants and public washrooms have begun using tissue in rolls fitted into a separate container that permits a required amount of tissue to be extracted and cut for use.

Such an apparatus that automatically dispenses roll tissue is illustrated in FIG. 1.

A conventional automatic roll tissue dispenser as illustrated includes: a housing 1, rolled tissue 2, a driving roller 31' and a driven roller 32' for compressing and feeding the rolled tissue 2, a contacting wetting device 5 that contactually discharges water to wet the rolled tissue 2, an indirect wetting device 6 that supplies water to the driven roller 32' to indirectly wet the tissue 2, an upper and lower blade 82' and 81' for cutting the wet tissue 2 in a predetermined length, and a tissue discharging unit 7 for discharging the cut tissue 2.

When such a conventional automatic tissue dispensing apparatus is used, the apparatus directly discharges water to wet tissue that is then cut into a predetermined length and dispensed.

An almost identical apparatus to the one above, while not illustrated in the diagrams herein, is disclosed in Korean Utility Model No. 1999-0019082 and Korean Patent Laid-Open Publication No. 1996-0042287.

However, because conventional automatic tissue dispensers use rolled tissue installed inside the housing, having to change the rolls is an inconvenience for a user. Furthermore, because it is hard to visually check the amount of tissue used, it is difficult to discern how much tissue there is remaining for use.

In addition, because conventional automatic tissue dispensers use rolled tissue installed inside the housing, they require a blade or similar cutting device to cut the tissue into predetermined lengths. After a certain duration of use, the blade wears and becomes blunt, necessitating replacement.

DISCLOSURE OF INVENTION

Technical Problem

An object of the present invention is to provide an apparatus for discharging tissue capable of enabling easy replacement of tissue and easy discerning of when to replace tissue, eliminating the need for a blade or cutting device on account of the tissue used being a non-rolled type, eliminating the possibility of mold and germ formation during prolonged storage in a sealed environment, and maintaining a clean and hygienic state.

Technical Solution

To achieve these objects and other advantages and in accordance with the purpose of the invention, as embodied and broadly described herein, there is provided a tissue dispensing apparatus for dispensing multiply folded tissues from a stack of multiple tissues including: a cartridge for holding the stack and having a through hole at one end; and a holding member disposed adjacent to the through hole of the cartridge and including an arm for grasping and removing the tissues one by one from a top of the stack by pivoting around a central axis of the holding member.

The arm is formed in an opening and closing pincer structure, and the tissue grasped by the arm reaches an opposite side from the cartridge through a pivoting of the holding member, whereupon the arm opens to deposit the tissue onto a conveyor belt, the conveyor belt extending from the cartridge to a tissue tray and driven over a plurality of rollers.

The inventive apparatus having the above structure allows a user to easily replace tissue, prevents tissue dispensing failure, and increases precision and reliability and reduces dispensing time over the related art.

The cartridge has a transparent window for allowing the stack held inside the cartridge to be visually verified. For these reasons, a user can visually verify how much tissue has been used and determine how much longer the remainder will last.

ADVANTAGEOUS EFFECTS

Because tissue is stacked in the apparatus according to the present invention, the process of cutting the tissue into predetermined lengths is not required, and replacement of the tissue by a user becomes much easier. Furthermore, because a user can readily check the amount of tissue used through visual means, the user can discern how much longer the remaining tissue will last.

The present invention eliminates a reduction of cutting effectiveness caused by worn blades, and virtually eliminates tissue dispensing failure and other malfunctions by dispensing tissue one at a time from a cartridge through a holding member, substantially increasing precision and reliability over conventional automatic tissue dispensers.

Because the apparatus is able to dispense stacked tissue by means of the holding member, the discharging time is greatly reduced compared to the related art.

Because tissues are stored in the cartridge in a dry state, they will not develop mold or germs when stored over a long duration, and will thus retain a clean and hygienic condition.

BRIEF DESCRIPTION OF THE DRAWINGS

The spirit of the present invention can be understood more fully with reference to the accompanying drawings. In the drawings:

FIG. 1 is a sectional view of a conventional wet tissue dispensing apparatus;

FIG. 2 is a perspective view of a tissue dispensing apparatus according to the present invention;

FIG. 3 is a phantom perspective view illustrating an internal structure of a tissue dispensing apparatus according to the present invention;

FIG. 4 is a perspective view illustrating steps for a method of folding tissue to be used in a tissue dispensing apparatus according to the present invention;

FIG. 5 is a perspective view illustrating steps for an alternative method of folding tissue to be used in a tissue dispensing apparatus according to the present invention;

FIG. 6 is a perspective view illustrating one embodiment of a cartridge for a tissue dispensing apparatus according to the present invention;

FIG. 7 is a perspective view illustrating another embodiment of a cartridge for a tissue dispensing apparatus according to the present invention;

FIG. 8 is a side view illustrating an operating stage of a tissue dispensing apparatus according to the present invention up to a point when a holding member holds a tissue;

FIG. 9 is a side view illustrating an operating stage of the tissue dispensing apparatus in FIG. 8 when the holding member returns to an original position after holding the tissue;

FIG. 10 is a perspective view of a cartridge for a tissue dispensing apparatus according to a further embodiment of the present invention;

FIG. 11 is a side view illustrating an operating stage of a tissue dispensing apparatus according to another embodiment of the present invention up to a point when a holding member holds a tissue; and FIG. 12 is a side view illustrating an operating stage of the tissue dispensing apparatus in FIG. 11 when the holding member returns to an original position after holding the tissue.

BEST MODE FOR CARRYING OUT THE INVENTION

Hereinafter, preferred embodiments of a tissue dispensing apparatus according to the present invention will be described in detail with reference to the accompanying drawings.

FIG. 2 is a perspective view of a tissue dispensing apparatus according to the present invention, and FIG. 3 is a phantom perspective view illustrating an internal structure of a tissue dispensing apparatus according to the present invention.

Referring to FIGS. 2 and 3, the apparatus for dispensing tissue 62 from a stack 61 according to the present invention includes a cartridge 60, 60', and 60" (shown respectively in FIGS. 6, 7 and 10) and a holding portion 90. The cartridge 60, 60' and 60" and the holding portion 90 are installed inside a main body 103. Disposed on the exterior of the main body 103 is a transparent window 105 allowing the cartridge 60, 60' and 60" to be viewed from the outside and a dispensing slot 104 for dispensing a wet tissue 64 (see, FIGS. 9 and 12).

The cartridge 60, 60' and 60" holds a stack 61 of tissues 62 that are folded several times and stacked one on top of another, and has a through hole 63, 63' and 63" at one end thereof.

The stack 61 consists of a plurality of tissues 62, with each tissue 62 folded multiple times to form a folded portion 62*a* and several opening portions 62*b*. The folded portions 62*a* of the tissues 62 are aligned in the stack 61.

FIG. 4 is a perspective view illustrating steps for a method of folding tissue to be used in a tissue dispensing apparatus according to the present invention.

The method of folding the tissue 62 shown in FIG. 4 includes: ① folding the square shape in half, ② folding the tissue in half again in a longitudinal direction, and ③ folding the tissue in half at the middle of the longitudinal direction. A tissue 62 folded in this manner has one folded portion 62*a* and three opening portions 62*b*.

FIG. 5 is a perspective view illustrating steps for an alternative method of folding tissue to be used in a tissue dispensing apparatus according to the present invention.

Referring to FIG. 5, an alternative method of folding the tissue 62 includes: ① folding opposing edges of the square tissue respectively inward, ② folding the tissue in half in a longitudinal direction, and ③ folding the tissue in half at the middle of the longitudinal direction. A thus folded tissue 62, like that in FIG. 4, has one folded portion 62*a* and three opening portions 62*b*.

However, a variety of folding methods not described by FIGS. 4 and 5 may be used to obtain one folded portion 62*a* and three opening portions 62*b*.

Such a tissue 62 may be made of a moisture absorbing textile or non-woven fabric, such as spunlace derived from rayon fibers.

FIG. 6 is a perspective view illustrating one embodiment of a cartridge for a tissue dispensing apparatus according to the present invention.

Referring to FIG. 6, the cartridge 60 includes a case 65, stopper 66, and supporting plate 67.

The case 65 for holding the stack 61 is a roughly rectangular parallelopiped shape, and has the through hole 63 formed at the top. A transparent window 76 is formed along the length on a side of the case 65 to allow visual checking of the stack 61 from the outside. By forming the transparent window 76 on the case 65, a user can always check how much of the stack 61 is remaining in the case.

At least one stopper 66 is formed adjacent to the through hole 63 at the top of the case 65 to provide elastic support to the edge of the highest portion of the stack 61. This stopper 66 is a structure consisting of a multi-edged plate 68 that pivots on a hinge axis 69 at its edges, and supports the uppermost portion of the stack 61 below the plate 68. A coil spring 70 connecting the plate 68 and the outer portion of the case 65 provides elastic support to the uppermost portion of the stack 61.

A supporting plate 67 is disposed at the lowermost portion of the stack 61, and has at least one elastic member 75 below it for providing upward elastic support to the stack toward the stopper 66. The supporting plate 67 has a pair of insertion holes 73 formed at an end thereof, and the insertion holes 73 have a pair of guide shafts 74 inserted therethrough. Each guide shaft 74 has a respective elastic member 75 encircling its outer surfaces for providing elastic support to the supporting plate 67. The guide shafts 74 may be formed along the longitudinal direction of the case 65 for guiding the supporting plate 67 towards the stopper 66.

FIG. 7 is a perspective view illustrating another embodiment of a cartridge for a tissue dispensing apparatus according to the present invention.

Referring to FIG. 7, the cartridge 60' is formed with a case 65', a stopper 66', a first supporting plate 71, a second supporting plate 72, and a driver 77.

Like the embodiment of FIG. 6, the case 65' for holding the stack 61 is a roughly rectangular parallelopiped shape, and has a through hole 63' formed at the top. A transparent window 76' is formed along the length of one side of the case 65' to allow visual checking of the stack 61 from the outside.

Also similar to the embodiment of FIG. 6, at least one stopper 66' is formed adjacent to the through hole 63' at the top of the case 65' to provide elastic support to the edge of the highest portion of the stack 61. This stopper 66' is a structure consisting of a multi-edged plate 68' that pivots on a hinge axis 69' at its edges, and supports the uppermost portion of the stack 61 below the plate 68'. A coil spring 70' connecting the plate 68' and the outer portion of the case 65' provides elastic support to the uppermost portion of the stack 61.

The first supporting plate 71 is provided at the lowermost point of the stack 61, and the second supporting plate 72 has at least one elastic member 75' thereabove for providing elastic support to the bottom of the first supporting plate 71 towards the top of the case 65'.

In further detail, the first supporting plate 71 and the second supporting plate 72 have ends with a respective pair of insertion holes 73' and 73" with a pair of guide shafts 74' inserted therethrough. The portions of the guide shafts 74' above the second support plate 72 have an elastic member 75' around their outer surfaces for providing elasticity to the first supporting plate 71. The guide shafts 74' may be formed along the case 65' in a longitudinal direction in order to guide the first and second supporting plates 71 and 72 in an upward and downward direction along the case 65'.

The driver 77 supplies driving force for allowing an upward and downward movement of the second supporting plate 72 along the case 65'.

The driver 77 includes a motor 80, a gear 81, and a gear shaft 83.

The motor 80 used for providing driving force may be a reversible switched reluctance motor. The gear 81 is attached to the shaft of the motor 80 for receiving driving force from the motor, and may be a worm, bevel, or other type of gear.

The gear shaft 83 may be formed longitudinally along the case 65' and parallel to the guide shafts 75.

The gear shaft 83 is rotatively mounted on the second supporting plate 72 to enable upward and downward movement of the second supporting plate 72 by means of rotational force supplied by the gear 81. The gear shaft 83 is configured in the shape of a screw with threaded passages 84 on its outer surface for meshing with the gear 81.

Specifically, the gear shaft 83 is rotatively inserted in a screw hole 78 formed in one end of the second supporting stand 72, and a bearing (not shown) may be disposed between the contacting surfaces of the screw hole 78 and the gear shaft 83 for facilitating a smooth rotation of the gear shaft 83.

The outer surface of the gear shaft 83 has threaded passages 84 formed therearound, which mesh with the teeth of the gear 81 that receives rotational force from the motor 80. That is, the gear 81 furnishes forward or reverse rotational force to the gear shaft 83 having the threaded passages 84, to move the second supporting plate 72 in an upward or downward direction along the gear shaft 83 towards the top or bottom of the case 65'.

Although not shown in the diagrams, a controller included inside the main body 103 controls the motor 80. For example, the controller may have a pressure sensor on the first supporting plate 71 for sensing the load of the stack 61 or several position sensors in the cartridge 60 for sensing the height of the stack 61. In either case, the controller receives signals from the sensors, compares the received signals with previously inputted data values, and rotates the motor 80 in a forward or reverse direction according to calculations based on the comparison.

A holding member 90 and 90' is formed proximally to the through hole 63, 63', and 63" of the cartridge 60, 60', and 60". The holding member 90 and 90' has an arm 91 and 91' for grasping a tissue 62 on the stack 61. The arm 91 and 91' removes held tissues 62 one at a time by pivoting on an axis 92 and 92'.

As shown in FIG. 3, the holding member 90 is disposed at the upper portion of the main body 103 near the through hole 63 for easily removing tissues 62 one at a time from the stack 61 in the cartridge 60.

FIG. 8 is a side view illustrating an operating stage of a tissue dispensing apparatus according to the present invention up to a point when a holding member holds a tissue, and FIG. 9 is a side view illustrating an operating stage of the tissue dispensing apparatus in FIG. 8 when the holding member returns to an original position after holding the tissue.

Referring to FIG. 8, the holding member 90 is driven by a motor 79 to slowly pivot around the axis 92 toward the through hole 63 of the cartridge 60, as shown in FIG. 6 (and FIG. 7). When the holding member 90 approaches the through hole 63 of the cartridge 60, the arm 91 opens. The opened arm 91 grasps the uppermost tissue 62 on the stack 61. Then, as shown in FIG. 8, the holding member 90 is driven in a reverse direction by the motor 79, and pivots on the axis 92 to return to original position. Here, the arm 91 opens at the top of the conveyor belt 93 described below to securely deposit the tissue 62 on top of the conveyor belt 93. The motor 79 used may be a reversible switched reluctance motor, and the arm 91 may be a pincer mechanism capable of performing grasping and opening operations.

The holding member 90 and the arm 91 formed thereon are controlled by a controller (not shown). For example, in order to sense the operation of the holding member 90, the controller receives signals from a plurality of position sensors (not shown) located in the main body 103, compares the received signals with previously inputted data values, and controls the pivoting movement of the holding member 90 and the opening and closing of the arm 91 based on calculations derived from the comparison.

In FIG. 9, the holding member returns to its original position in FIG. 8, and simultaneously deposits the tissue 62 onto the conveyor belt 93 below by opening the arm 91.

The conveyor belt 93 has a motor (not shown) rotating a plurality of rollers 95 for allowing the conveyor belt 93 to convey a tissue 62 (placed thereupon by the opening arm 91 of the holding member 90) to a tissue tray 96.

As shown in FIG. 3, the conveyor belt 93 extends from the cartridge 60 to the dispensing slot 104 of the main body 103. The tissue tray 96 is disposed at the dispensing slot 104 of the main body 103.

As shown in FIGS. 8 and 9, at least one auxiliary conveyor belt 94 for grasping the top and bottom surfaces of the tissue 62 when supplying the tissue 62 to the tissue tray 96 may be provided above the conveyor belt 93. Like the conveyor belt 93, the structure of the auxiliary conveyor belt 94 includes a driving motor (not shown) rotating a plurality of rollers 95.

When the conveyor belt 93 and the auxiliary conveyor belt 94 grasp the top and bottom surfaces of the tissue 62 when conveying the tissue 62, the tissue 62 can more reliably be conveyed to the dispensing slot 104 of the main body 103. The controller (not shown) controls the conveyor belt 93 and the auxiliary conveyor belt 94.

Furthermore, the tissue 62 supplied by the conveyor belt 93 does not fall directly onto the tissue tray 96, but is held by a tissue holding stopper 97 (shown in FIG. 3) formed above the tissue tray 96, or at the end of the conveyor belt 93. The tissue holding stopper 97 is formed in a pincer shape. Because this type of stopper 97 is similar to ones used by queuing ticket dispensers, cash machines, etc. common in banks and cinemas, description of its form and function will be omitted herefrom.

As shown in FIG. 3, a spray nozzle 98 sprays water pressurized by a pump 100 and wets the tissue 62 discharged by the holding member 90.

The spray nozzle 98 is connected to a water tank 99 through a pipe 101.

In further detail, the spray nozzle 98 for spraying water pressurized by the pump 100 is provided at a side of the holding member 90 and 90'. The spray nozzle 98 sprays water to wet tissue 62 that progresses along the conveyor belt 93.

Although the spray nozzle 98 sprays water from above the tissue 62 only in FIG. 3, it can be installed both above and below the conveyor belt 93 to simultaneously spray the tissue from both the top and bottom, depending on requirements.

The water tank 99 (shown in FIG. 3) is disposed in the lower portion of the main body 103, and may include a heater (not shown) to one side thereof for heating the water.

Such a heater raises the temperature of water to be sprayed from the spray nozzle 98, so that the wet tissue 64 dispensed to a user is not cold, but warm, thus providing a comforting sensation.

In addition, a water tray 102 for collecting residual water after the tissue 62 has been wetted by the spray nozzle 98 may further be provided below the conveyor belt 93.

The operation of the mechanism for dispensing tissue from the stack according to the present invention is shown in FIGS. 3, 8, and 9.

First, when a user presses a button (not shown) located on the outside of the main body 103 for dispensing wet tissue, as shown in FIG. 8, the controller (not shown) receives the signal and prompts the holding member 90 to pivot towards the through hole 63 of the cartridge 60 (in FIG. 6 or 7). When the holding member 90 reaches the top of the stack 61 in the cartridge 60, the arm 91 grasps the tissue 62.

The tissue 62 grasped by the arm 91 is then moved toward the conveyor belt 93 through a reverse pivoting of the holding member 90, as shown in FIG. 9. When the holding member 90 nears the conveyor belt 93, the arm 91 opens and deposits the tissue 62 onto the conveyor belt 93.

The conveyor belt 93 moves the tissue 62 removed from the cartridge 60 by the holding member 90 to a position beneath the spray nozzle 98 by means of the rollers 95. The spray nozzle 98 sprays water by means of pressure from the pump 100 onto the tissue 62 to render it a wet tissue 64. Here, the water to be sprayed by the spray nozzle 98 may be precedently heated by a heater (not shown).

Then, the wet tissue 64 that moves by means of the conveyor belt 93 is grasped at the top and the bottom by the auxiliary conveyor belt 94 and securely moved further to the tissue holding stopper 97, which stops the movement of the wet tissue 64.

The stopped wet tissue 64 can then be pulled from the tissue holding stopper 97 by the user and placed in readiness for use on the tissue tray 96 or used directly by a user needing a wet tissue 64 to wipe his/her hands of food deposits or clean his/her hands before consuming a meal.

FIG. 10 is a perspective view of a cartridge for a tissue dispensing apparatus according to a further embodiment of the present invention.

Referring to FIG. 10, the cartridge 60" includes a case 65" and a stopper 66".

Like the embodiments shown in FIGS. 6 and 7, the case 65" for holding the stack 61 is a roughly rectangular parallelopiped shape, and has the through hole 63" formed at the bottom. A transparent window 76" is formed along the length of one side of the case 65" to allow visual checking of the stack 61 from the outside.

At least one stopper 66" is formed adjacent to the through hole 63" at the bottom of the case 65" to provide elastic support to the edge of the lowest portion of the stack 61. This stopper 66" is a structure consisting of a multi-edged plate 68" that pivots on a hinge axis 69" at its edges, and supports the lowermost portion of the stack 61 above the plate 68". A coil spring 70" connecting the plate 68" and the outer portion of the case 65" provides elastic support to the lowermost portion of the stack 61.

Unlike the embodiments in FIGS. 6 and 7, because the cartridge 60" in FIG. 10 uses simple gravitational force to lower the stack 61 to the through hole 63", a separate supporting plate 67, first supporting plate 71, second supporting plate 72, and elastic members 75 and 75' for lowering the stack 61 are not required. In this aspect, the cartridge 60" in FIG. 10 has a lower manufacturing cost than the cartridges 60 and 60' in FIGS. 6 and 7.

FIG. 11 is a side view illustrating an operating stage of a tissue dispensing apparatus according to another embodiment of the present invention up to a point when a holding member holds a tissue, and FIG. 12 is a side view illustrating an operating stage of the tissue dispensing apparatus in FIG. 11 when the holding member returns to an original position after holding the tissue.

In the case where a cartridge 60" in FIG. 10 is disposed above a holding member 90', the holding member 90' is driven by a motor 79' to pivot in an upward direction on an axis 92', as shown in FIG. 11. Then, the arm 91' of the holding member 90' grasps the tissue 62 at a lowermost point of the cartridge 60". The motor 79' then reverses in FIG. 12 to pivot the holding member 90' on the axis 92' and lower it, whereupon the arm 91' of the holding member 90' opens to deposit the tissue 62 onto the conveyor belt 93.

The holding member 90' in the embodiment illustrated in FIGS. 11 and 12 may have a smaller angle of movement than the embodiment illustrated in FIGS. 8 and 9. Thus, the tissues 62 can be deposited onto the conveyor belt 93 that much more rapidly.

INDUSTRIAL APPLICABILITY

The inventive apparatus for dispensing tissue improves on conventional tissue dispensers by using stacked individual tissues instead of uncut rolled tissue, and therefore eliminates the need to cut the tissue into predetermined lengths, enables easy replacement of tissue by a user, and allows a user to visually check the amount of tissue used and the amount remaining.

Unlike conventional tissue dispensers, the dispenser of the present invention does not require a blade, so that the problem caused by a dull blade of reduced cutting effectiveness is eliminated. Also, by dispensing stacked tissues in the cartridge one at a time by means of the holding member, the problem of dispensing failure is virtually negated, and precision and accuracy of the dispenser increases in comparison to conventional dispensers.

By using the holding member to dispense stacked tissues, the inventive dispenser dispenses tissues much more quickly than conventional dispensers.

Because the stacked tissues are not stored in a wet condition, but are stored in a dry condition inside the cartridge, the possibility of mold and germ formation over a prolonged storage period is unlikely, thus allowing clean and hygienic storage of tissues.

The invention claimed is:

1. A tissue dispensing apparatus for dispensing multiply folded tissues from a stack of multiple tissues comprising:

a cartridge for holding the stack and including a through hole at one end;

a holding member disposed adjacent to the through hole of the cartridge and including an arm for grasping and removing the tissues one by one from the stack by pivoting around a central axis of the holding member;

a conveyor belt driven by a plurality of rollers, extending to a tissue tray positioned at an opposite side of the cartridge and conveying the removed tissue to the tissue tray; and a controller controlling the driving of the tissue dispensing apparatus comprising the cartridge, the holding member and the conveyor belt, wherein the holding member is installed to reciprocate around the axis between the through hole and the upper surface of the conveyor belt by the forward and reverse rotation of a motor, the arm is formed in grasping and opening pincer structure, and the control unit enables the arm to open at the through hole of the cartridge and hold tissues from top or bottom surface of the stack of tissues with pivoting of the holding member caused by the motor's driving, and then to open again and deposit tissues onto the conveyor belt with further pivoting of the holding member caused by driving of the motor.

2. The tissue dispensing apparatus according to claim 1, wherein the cartridge further includes:

a case for holding the stack;

at least one stopper pivotably formed at a top of the cartridge for providing elastic support to a highest portion of the stack; and a supporting plate disposed at a lowest portion of the stack and having at least one elastic member for providing upward elastic support to the stack towards the stopper.

3. The tissue dispensing apparatus according to claim 2, further comprising a guide shaft formed along a longitudinal direction of the case and inserted through the supporting plate for guiding an upward and downward movement of the supporting plate, and including an outer surface encircled by the elastic member below the supporting plate.

4. The tissue dispensing apparatus according to claim 1, wherein the cartridge further includes:

a case for holding the stack;

at least one stopper pivotably formed at a top of the case for providing elastic support to a highest portion of the stack;

a first supporting plate for supporting a lowest portion of the stack;

a second supporting plate having at least one elastic member thereabove for supporting a bottom of the first supporting plate and providing upward elastic support to the first supporting plate towards the stopper; and a driver for supplying a driving force to move the second supporting plate upward and downward along the case.

5. The tissue dispensing apparatus according to claim 4, further comprising a guide shaft formed along a longitudinal direction of the case and inserted through the first and second supporting plates for guiding an upward and downward movement of the first and second supporting plates, and including an outer surface encircled by the elastic member between the first and second supporting plates.

6. The tissue dispensing apparatus according to claim 4, wherein the driver includes:

a motor for outputting force;

a gear for relaying the force from the motor; and a gear shaft formed along a length of the case and rotatively installed through the second supporting plate for moving the second supporting plate upward and downward via the force relayed by the gear, the gear shaft having spiraling threaded passages formed on an outer surface thereof for meshing with the gear.

7. The apparatus according to claim 1, wherein the cartridge further includes a case for holding the stack and at least one stopper pivotably formed at a lower portion of the case for supporting a lowest portion of the stack.

8. The apparatus according to claim 1, wherein the cartridge further includes a transparent window for allowing the stack held inside the cartridge to be visually verified.

9. The tissue dispensing apparatus according to claim 1, further comprising at least one auxiliary conveyor belt disposed above the conveyor belt for wedging and conveying the tissue to the tissue tray.

10. The tissue dispensing apparatus according to claim 9, further comprising a tissue holding stopper disposed above the tissue tray for holding the tissue supplied by the conveyor belt.

11. The apparatus according to claim 1, further comprising a spray nozzle for spraying and wetting tissue removed by the holding member through a pump-induced pressure.

12. The apparatus according to claim 11, wherein the spray nozzle is connected via a passage to a water tank for holding water.

13. The apparatus according to claim 12, wherein the water tank has a heater for heating water.

* * * * *